US006312294B1

(12) United States Patent
Lai

(10) Patent No.: US 6,312,294 B1
(45) Date of Patent: Nov. 6, 2001

(54) CABLE CONNECTOR WITH IMPROVED TERMINALS

(75) Inventor: Chin-Te Lai, Tao-Yuan (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/472,760

(22) Filed: Dec. 27, 1999

(51) Int. Cl.[7] ..... H01R 13/04
(52) U.S. Cl. ..... 439/692; 439/733.1; 439/610
(58) Field of Search ..... 439/692, 733.1, 439/610

(56) References Cited

U.S. PATENT DOCUMENTS 5,692,928 * 12/1997 Nelson et al. ..... 439/733.1
5,722,861 * 3/1998 Wetter ..... 439/701

* cited by examiner

*Primary Examiner*—Gary Paumen
(74) *Attorney, Agent, or Firm*—Wei Te Chung

(57) ABSTRACT

A cable connector comprises a housing and a number of terminals received in the housing. The housing has a mating surface and a mounting surface opposite to the mating surface. The housing defines one or more rows of receiving holes extending through the mating surface and the mounting surface for receiving the terminals. A cross-section of the receiving hole presents a slanted rectangle section plus a pair of recessing sections on opposite long sides of the slanted rectangle section. Each recessing section defines a vertical peripheral wall. The terminal comprises a gradually twisted contact portion at one end thereof, a straight extending portion connected with the contact portion, and a securing portion at the other end thereof correspondingly twisted in a similar way as the contact portion. The straight extending portion has a width comparable to a horizontal distance between the peripheral walls of the recessing sections of the receiving hole. The securing portion is securely received in the slanted rectangle section of the housing.

1 Claim, 5 Drawing Sheets

CABLE CONNECTOR WITH IMPROVED TERMINALS

BACKGROUND OF THE INVENTION

The present invention relates to a cable connector, and particularly to a cable connector having improved terminals fitting into a smaller space for data transmission.

U.S. Pat. No. 5,722,861 discloses a cable connector with data transmission terminals. Because a retaining space for receiving the data transmission terminals in the housing is limited, the terminals often insert molded in an insulative block thereby saving the retaining space of the housing. U.S. Pat. No. 5,722,861 discloses a cable connector 200 as shown in FIG. 5 which has an insulative housing 80 and a plurality of terminal modules 90 received in the housing 80. The terminal modules 90 are made by insert molding terminals 94 within the insulative blocks 92 thereby allowing more terminals 94 to be received in a limited space. However, manufacturing a conventional cable connector by insert molding the terminals within insulative blocks may waste time and increase production cost. Hence, an improved cable connector having a system for high-speed signal transmission is required to overcome the disadvantages of the prior art.

BRIEF SUMMARY OF THE INVENTION

An object of the present invention is to provide a cable connector having a plurality of improved terminals fitting into a smaller space for positioning in the limited space of an insulative housing.

A cable connector comprises an insulative housing, a plurality of data transmission terminals received in one side of the insulative housing, a system for high-speed signal transmission received in an opposite side of the insulative housing, and a shield covering the housing.

The housing has a mating surface and a mounting surface opposite to the mating surface. The housing defines one or more rows of receiving holes extending through the mating surface and the mounting surface for receiving the data transmission terminals. A cross-section of the receiving holepresents a slanted rectangle section plus a pair of recessing sections on opposite long sides of the slanted rectangle section. Each recessing section defines a vertical peripheral wall. The data transmission terminal comprises a gradually twisted contact portion at one end thereof, a straight extending portion connected with the contact portion, and a securing portion at the other end thereof correspondingly twisted in a similar direction as the contact portion. The straight extending portion has a width comparable to a horizontal distance between the peripheral walls of the recessing sections of the receiving hole. The securing portion is securely received in the slanted rectangle section of the housing thereby saving the lateral space of the housing.

Other objects, advantages and novel features of the invention will become more apparent from the following detailed description of the present embodiment when taken in conjunction with the accompanying drawings.

DETAILED DESCRIPTION OF THE INVENTION

Figure 1:
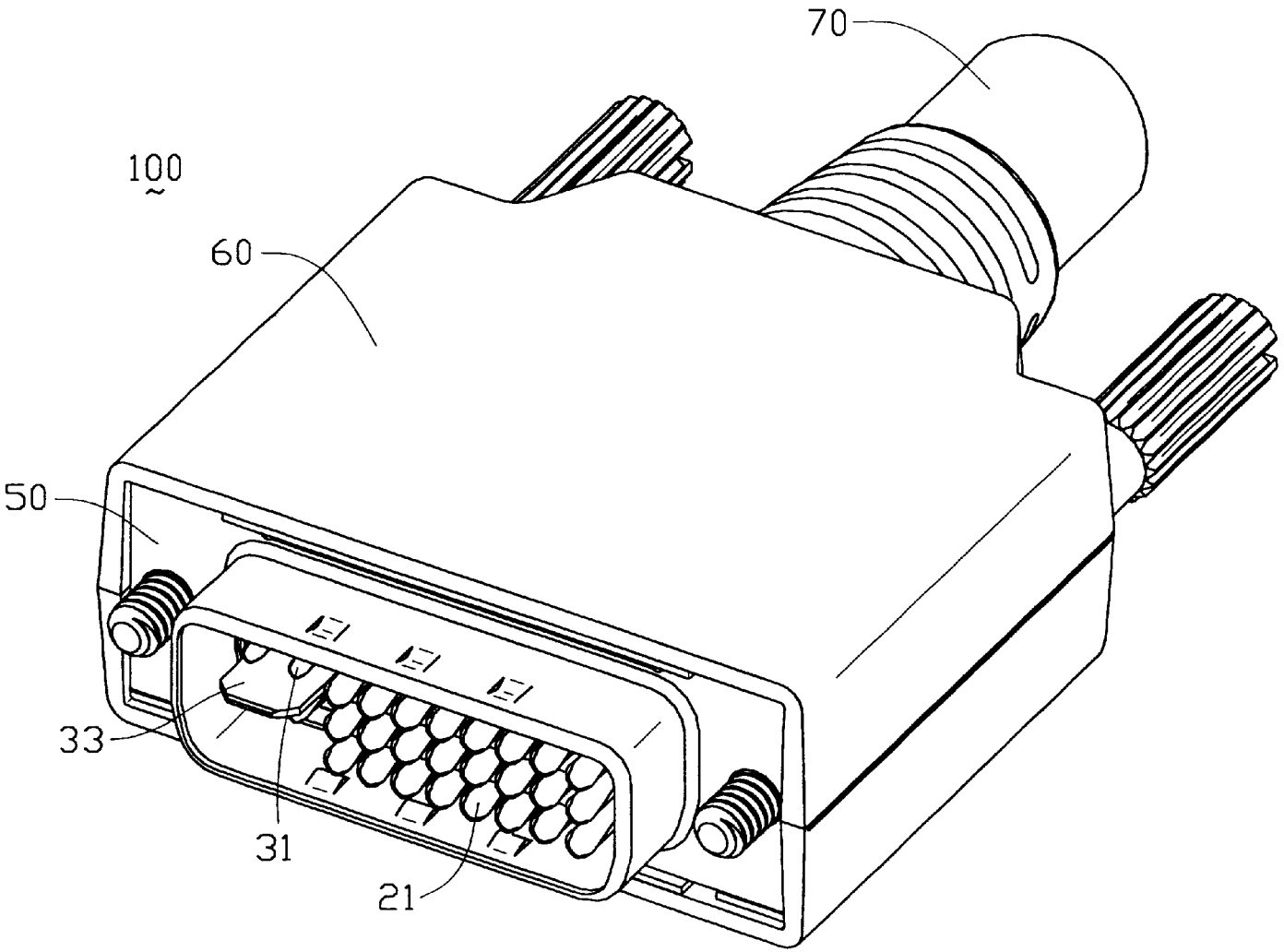
FIG. 1 is a perspective assembled view of a cable connector of the present invention.
Figure 2:
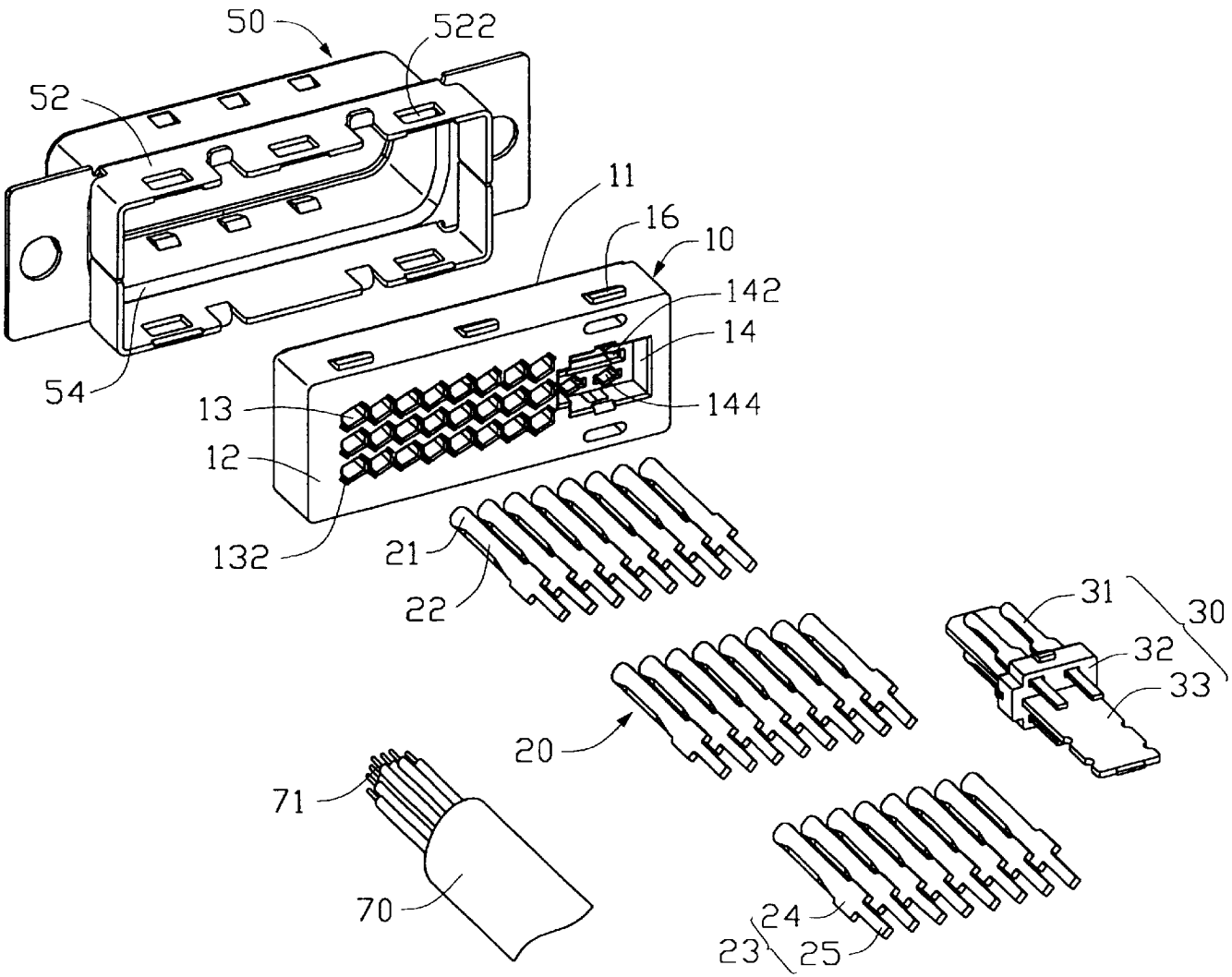
FIG. 2 is a partially exploded view of the cable connector of the present invention.

Referring to FIG. 1 and FIG. 2, a cable connector 100 for terminating an electrical cable 70 comprises a pair of covers 60, a conductive shield 50 attached to a front face of the covers 60, an insulative housing 10 received within the covers 60, a plurality of data transmission terminals 20 received in the insulative housing 10, and a system for high-speed signal transmission 30 (see FIG. 2) assembled in the housing 10.

Figure 4:
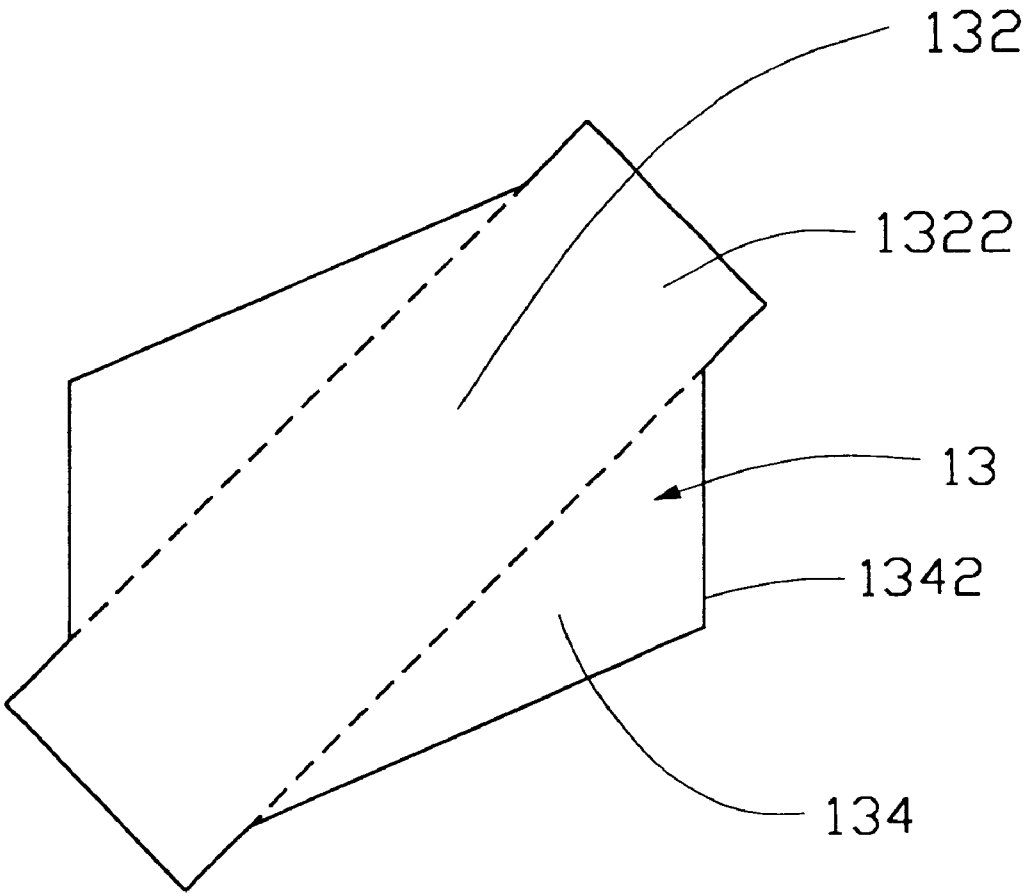
FIG. 4 is a cross-sectional view of a receiving hole of the housing of the cable connector.
Figure 5:
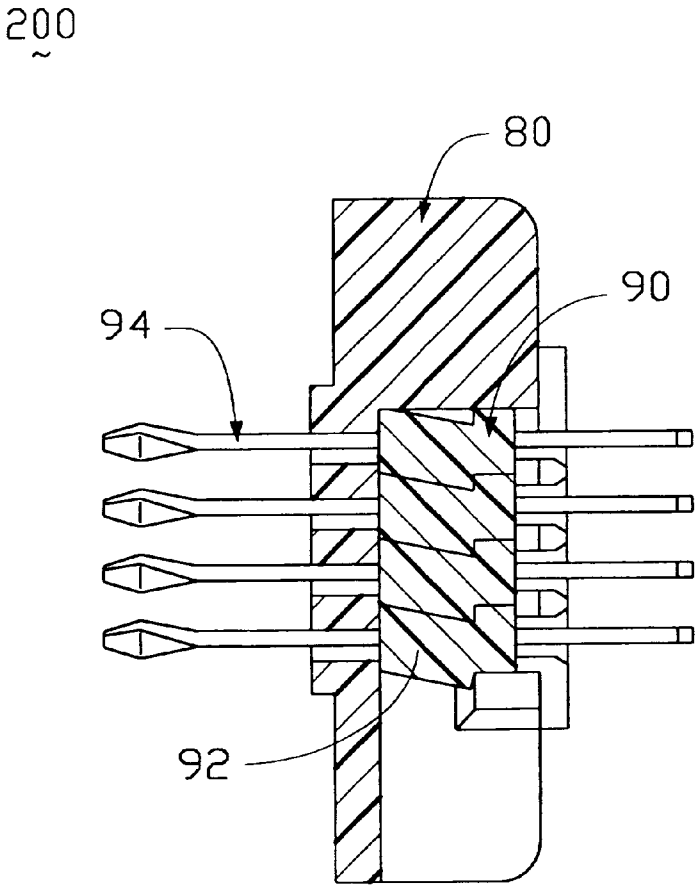
FIG. 5 (PRIOR ART)
FIG. 5 is a cross-sectional view of a conventional cable connector.

The rectangular insulative housing 10 has a mating surface 11 and a mounting surface 12 opposite to the mating surface 11. One or more rows of receiving holes 13 extend through the mating surface 11 and the mounting surface 12 for receiving the data transmission terminals 20 at one side of the housing 10. A cross-section of each receiving hole 13 (see FIG. 4) presents a slanted rectangle section 132 added to a pair of recessing sections 134 on opposite long sides of the slanted rectangle section 132. Each recessing section 134 defines a vertical peripheral wall 1342. Both ends of each receiving hole 13 define two unshaped positioning sections 1322. The cross-section of each receiving hole 13 is uniform all the way through the housing 10.

A cavity 14 is defined in the other side of the mounting face 12 to accommodate the system for high-speed signal transmission 30. A plurality of terminal through holes 144 and a slot 142 are defined through the insulative housing 10 from the mating surface 11 to a front wall (not labeled) of the cavity 14. A plurality of protrusions 16 are formed on both an upper flange (not labeled) and a lower flange (not labeled) for engaging with the shield 50.

Each data transmission terminal 20 comprises a gradually twisted contact portion 21 in one end thereof, a straight extending portion 22 connected with the contact portion 21, and a securing portion 23 at the other end thereof twisted in a direction similar to that of the contact portion 21. The straight extending portion 22 has a width comparable to a horizontal distance between the peripheral walls 1342. The securing portion 23 comprises an interfering portion 24 for positioning in the slanted rectangle section 132 of the receiving hole 13 and a solder portion 25 at the distal end connecting with the interfering portion 24 for soldering to the electrical cable 70.

Referring to FIG. 2, the system for high-speed signal transmission 30 comprises a plurality of high-speed signal terminals 31, a grounding plate 33, and an insulative spacer 32. The terminals 31 and the grounding plate 33 are retained in the spacer 32.

The shield 50 has a pair of curved flanges 52 defining a receiving space 54 for enclosing the housing 10. A plurality of notches 522 corresponding to the protrusions 16 of the housing 10 is defined in the two flanges 52.

The electrical cable 70 encloses a plurality of center conductors 71 for electrically connecting with the solder portions 25 of the data transmission terminals 20 and the high-speed signal terminal 31.

Figure 3:
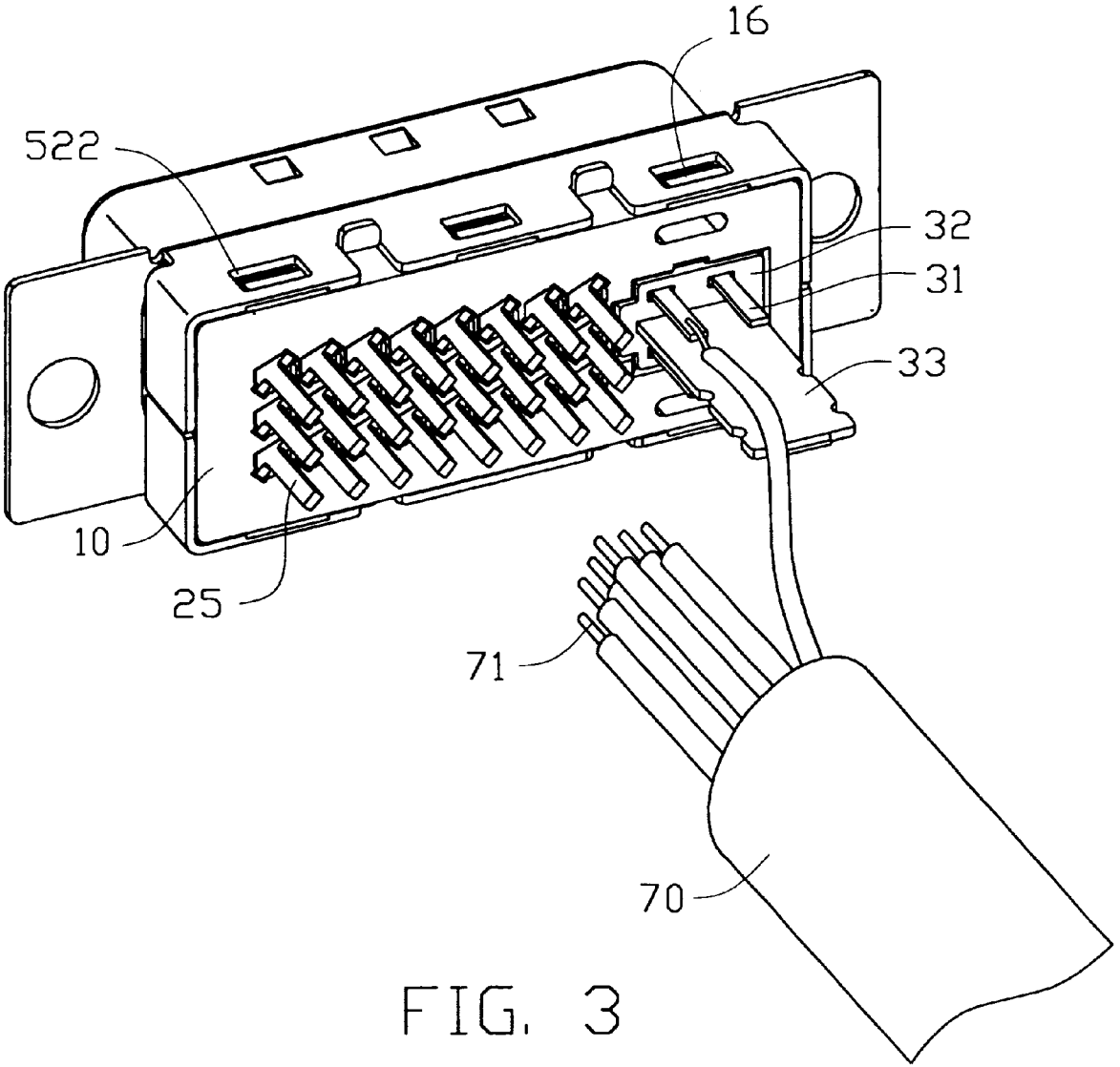
FIG. 3 is an assembled view of FIG. 2.

Referring to FIG. 3, in assembly, the data transmission terminals 20 are assembled into the receiving holes 13 from the mounting surface 12 of the insulative housing 10. The contact portions 21 (see FIG. 1) of the data transmission terminals 20 extend out of the mating surface 11 for contacting with a mating connector (not shown). The extending portions 22 extend through the receiving holes 13 between the two peripheral walls 1342 of the receiving holes 13. The data transmission terminals 20 are fixed in the receiving holes 13 by two sides of the interfering portion 24 of the securing portions 23 interferentially engaging with the positioning sections 1322 of the slanted rectangle section 132 of the receiving holes 13.

The high speed signal transmission system 30 is assembled into the cavity 14 of the housing 10 by the high-speed signal terminals 31 correspondingly securing into the through holes 144, the grounding plate 33 correspondingly inserting into the slot 142, and the spacer 32 securing into the cavity 14. The housing 10 with the data transmission terminals 20 and the high-speed signal transmission system 30 are then secured into the receiving space 54 of the shield 50 by the protrusions 16 correspondingly engage with the notches 522.

The center conductors 71 of the electrical cable 70 are correspondingly soldered to the solder portions 25 of the data transmission terminals 20 and the high speed signal terminals 31 for electrical transmission.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a mating surface, a mounting surface opposite to the mating surface, and one or more rows of receiving holes extending through the mating surface and the mounting surface, a cross-section of the receiving hole presenting a slanted rectangle section plus a pair of recessing sections on opposite long sides of the slanted rectangle section, each recessing section defining a vertical peripheral wall, two u-shaped positioning sections being defined at two ends of the slanted rectangle section; and a plurality of terminals correspondingly received in the receiving holes of the insulative housing, each terminal comprising a gradually twisted contact portion in one end thereof, a straight extending portion connected with the contact portion, and a securing portion in the other end thereof twisted in a similar way as the contact portion, the straight extending portion having a width comparable to a horizontal distance between the peripheral walls of the recessing sections of the receiving hole, the securing portion having an interfering portion securely received in the u-shaped positioning sections of the slanted rectangle section of the receiving hole;

further comprising a metal shield, a pair of curved flanges extending from the shield, the flanges defining a receiving space for receiving the housing;

wherein the housing forms a plurality of protrusions respectively on an upper flange and a lower flange, and wherein the flanges of the shield define a plurality of notches engaged with the protrusions;

wherein the insulative housing further defines a cavity in the mounting surface beside the receiving holes;

further comprising a signal transmission system received in the cavity of the housing.

* * * * *